US005723434A

United States Patent [19]

Falk et al.

[11] Patent Number: 5,723,434

[45] **Date of Patent: *Mar. 3, 1998**

[54] ISOTROPIC LIQUIDS COMPRISING HYDROPHOBICALLY MODIFIED POLAR POLYMER

[75] Inventors: Nancy Ann Falk, Livingston; Barbara Bory, Fort Lee; Tamara Padron, North Bergen; Tirucherai Varahan Vasudevan, West Orange; Diane Wolf, Bridgewater, all of N.J.; Jeanie Lum, Flushing, N.Y.

[73] Assignee: Lever Brothers Company, Division of Conopco, Inc., New York, N.Y.

[ * ] Notice: The term of this patent shall not extend beyond the expiration date of Pat. No. 5,719,117.

[21] Appl. No.: 591,789

[22] Filed: Jan. 25, 1996

[51] Int. Cl.[6] ..... C11D 3/37; C11D 17/00

[52] U.S. Cl. ..... 510/475; 510/340; 510/351; 510/352; 510/427; 510/429; 510/432; 510/440; 510/476; 510/497; 510/498; 510/505

[58] Field of Search ..... 510/475, 476, 510/477, 340, 351, 352, 427, 429, 432, 470, 498, 497, 505

[56] References Cited

U.S. PATENT DOCUMENTS

| | | | |
|---|---|---|---|
| 4,759,868 | 7/1988 | Clarke | 252/170 |
| 5,147,576 | 9/1992 | Montague et al. | 252/174 |
| 5,264,142 | 11/1993 | Hessel et al. | 510/303 |
| 5,308,530 | 5/1994 | Aronson et al. | 252/174.12 |
| 5,411,674 | 5/1995 | Tagata et al. | 510/424 |

OTHER PUBLICATIONS

Brochure from National Starch & Chemical Company relating to Narlex H1200.

Paper by R. Hodgetts et al. presented at Seise Parfum and Woschmittel Conference (SEPAWA), Durchheim, Germany on Oct. 18–20th, 1995.

*Primary Examiner*—Paul Lieberman
*Assistant Examiner*—Lorna M. Douyon
*Attorney, Agent, or Firm*—Ronald A. Koatz

[57] ABSTRACT

Isotropic liquid detergent composition comprises specific soil antiredeposition polymers containing a hydrophilic backbone and monomer with hydrophobic side chains. When the molar ratio of the number hydrophilic groups to number of hydrophobic groups on said polymers is below certain critical levels, it has been unexpectedly found that the stability (i.e., clarity) of the composition remarkably increases. The solubility of the polymer is further dependent on the type and amount (minimum required) of hydrotrope; surfactant type and levels; and minimum electrolyte levels.

15 Claims, No Drawings

ISOTROPIC LIQUIDS COMPRISING HYDROPHOBICALLY MODIFIED POLAR POLYMER

FIELD OF THE INVENTION

The present invention relates to so-called "isotropic" (i.e., non-structured) detergent compositions comprising certain hydrophobically modified polar polymers (i.e., soil anti-redeposition polymers) which have not previously been used in such isotropic formulations. The hydrophobic modification allows formation of far more stable solutions (clear versus hazy) than otherwise possible. Variables which make the compositions more hydrophobic (i.e., use of appropriate hydrotrope; greater amounts of salt/electrolyte/builder; less anionic relative to nonionic) are especially preferred.

BACKGROUND

The liquid detergent art may be broken down into those detergents in which all components of the liquid system are dissolved into one single liquid phase (e.g., the isotropic liquids); and those which contain sufficient surfactant and/or electrolyte to form a lamellar droplet comprising "onion" type layers dispersed in an electrolyte medium which is capable of suspending undissolved particles in the liquid. These latter liquids are also known as so-called duotropic or structured liquids.

One problem in the structured liquid art has been to find a balance between the stability of the composition and the desirable viscosity of the composition. The viscosity is dependent on volume fraction of liquid occupied by the lamellar droplets. While increasing volume fraction is beneficial from a stability point of view, it also creates higher viscosity which may be undesirable from the point of view of dispensing as well as dispersion in the washing machine.

U.S. Pat. No. 5,147,576 to Montague et al., where the interrelation between surfactants, electrolytes, volume fraction etc. is discussed (and which hereby is incorporated by reference into the subject application), relates to novel deflocculating polymers which allow incorporation of more surfactants and/or electrolytes while still maintaining a stable, low viscosity product.

The polymers of the Montague et al. reference comprise a hydrophilic backbone which is generally a linear, branched or highly cross-linked molecular composition containing one or more types of hydrophilic monomer units; and hydrophobic side chains, for example, selected from the group consisting of siloxanes, saturated or unsaturated alkyl and hydrophobic alkoxy groups, aryl and aryl-alkyl groups, and mixtures thereof.

These polymers were not, however, taught for use in isotropic aqueous liquids.

While the Montague et al. reference discloses at column 8, lines 26–29 that some polymers having hydrophilic backbones and hydrophobic side chains are known (e.g., U.S. Pat. No. 4,759,868 to Clarke), there is no teaching there that decreasing the molar ratio of hydrophilic monomers to hydrophobic side chains (e.g., to under about 20) will result in increased solubility of the polymer, thereby leading to enhanced stability and clear appearance of the isotropic liquid. In fact, U.S. Pat. No. 4,759,868 to Clarke suggests the effect to be opposite to that observed in the subject invention, i.e., the reference suggests that a lower molar ratio of hydrophilic to hydrophobic monomer (such that the polymer has more pendant side groups and is more hydrophobic) should result in decreased solubilization. The subject invention, by contrast, teaches greater hydrophobicity (i.e., more pendant groups) leads to enhanced solubilization.

Furthermore, the use of a hydrotrope is not taught in either U.S. Pat. No. 5,147,576 to Montague et al. or U.S. Pat. No. 4,759,868 to Clarke. Indeed, the use of hydrotrope is counterproductive in structured, lamellar liquids to the extent that it inhibits formation of the lamellar phase critical in such structured liquids (see column 19, line 17–24 of Montague et al.)

By contrast, the use of a hydrotrope is essential in the isotropic liquid detergent formulations of the subject invention because those formulations not containing the hydrotrope have a much narrower formulation flexibility in terms of the surfactant composition and level as well as the electrolyte level. In fact, the type and level of hydrotrope used may critically govern the solubility of the hydrophobically modified polymers of the type used in the subject invention. That is, while not wishing to be bound by theory, those hydrotropes which most enhance hydrophobicity of the composition are superior in terms of aiding solubilization of the polymer. The criticality of the hydrotrope type used on the polymer solubility is shown in the examples.

In addition, U.S. Pat. No. 4,759,868 to Clarke is limited to high nonionic surfactant compositions whereas the system disclosed in the present application are not so limited (mixtures of anionic and nonionic surfactants are preferred). As will also be shown in the examples, the ratio of anionic to nonionic surfactants can play a critical role in determining the solubility of the hydrophobically modified polymers of the type disclosed in the present invention (i.e., compositions more nonionic in character being preferred).

Finally, U.S. Pat. No. 5,308,530 to Aronson et al. also discloses certain hydrophobically modified hydrophilic polymers. Specifically, the reference teaches a builder which is an interpolymer $[A\text{-}B]_m\text{-}[C]_n$ where A and B are hydrophilic groups modified by hydrophobic monomer C. In this reference, A cannot equal B. In the polymer of the invention, by contrast, the hydrophilic chain is comprised of acrylate monomer only (i.e., is a homopolymer). These molecules are more soluble than those with mixtures of A and B.

Although U.S. Pat. No. 5,308,530 does teach the use of hydrotropes and surfactant blends, the criticality in terms of (1) hydrotrope type; (2) surfactants type (anionic vs. nonionic); and (3) salt concentration in enhancing the compatibility between the polymer and the detergent formulation is clearly not recognized. That is the reference does not recognize different types and levels of hydrotrope can be used to significantly enhance or reduce the solubility of these polymers in solution. Stated differently, there is no comparison of the different solubilities of the polymer based on type and levels of hydrotrope (indeed only one formulation, number 2 of example 3 ( see column 16, line 51) is ever tested. So many variables are tested there is clearly no recognition of the effect of any one variable (i.e., hydrotrope).

Further, no trend with regard to actives used in the composition or salt concentrations used was observed in the Aronson et al. reference. Again, this contrasts with the subject invention where effect of types of surfactant on solubility of polymer or effect of electrolyte concentrations on solubility of polymer (i.e., electrolyte was required) was clearly observed.

Finally, liquids of the Aronson et al. reference are not pH jump liquids and do not contain sorbitol, such as the preferred liquids of the subject invention. The pH of the Aronson et al. liquids is about 10 while the pH of the liquids of the invention is about 6.0 to about 8.0.

In short, Montague et al. and Clarke are structured liquid references versus isotropic liquid references wherein the use of hydrotropes is not prescribed; and Aronson et al. contains polymers which are structurally different (A cannot equal B); and wherein compositional variables for enhancing solubility are not recognized in any event. Further, the liquids of Aronson et al. are not pH jump liquids.

Applicants also note a brochure from National Starch & Chemicals Company disclosing use of a acrylate/styrene copolymer (H1200) in various powder or liquid cleaners. The specific isotropic liquids of the invention and ability to improve anti-redeposition properties are not disclosed. Applicants further enclose a paper by R. Hodgetts et al. at the Seise Portum and Woschmititel Conference (SEPAWA), of Bacl. Durchheim (Germany) on Oct. 18–20th, 1995. This reference does not appear to disclose use of the H1200 polymers in isotropic liquids, let alone the specific isotropic compositions of the invention.

BRIEF SUMMARY OF THE INVENTION

Unexpectedly, applicants have found that in isotropic liquid compositions comprising (1) a surfactant or mixture of surfactants (e.g., mixture of anionic and nonionic surfactants); (2) a hydrotrope and (3) electrolyte, the use of polymer having a hydrophilic backbone (hydrophilic backbone made of one monomer only, e.g., acrylate) wherein there is a critical molar ratio of hydrophilic groups (e.g., the backbone) to hydrophobic "anchors" ("tail") attached to the backbone (or in other words, molar ratio of hydrophilic to hydrophobic monomers), yields solutions which are more stable (e.g., clearer) and have better anti-redeposition properties than they otherwise would be if (1) the specific polymer with these ratios were not used; and (2) hydrotrope, and electrolyte variables (and preferred surfactant variables) were not met.

For purposes of this invention, it has been found that "hazy" formulations are unstable and tend to phase separate (i.e., within 7 days of preparation). Such phase separation is not acceptable in product formulation.

DETAILED DESCRIPTION OF THE INVENTION

The present invention relates to specific isotropic liquids (i.e. having specific amounts and types of hydrotrope; preferred surfactants; and minimum electrolyte) containing specific polymers which polymers have a critical molar ratio of number of hydrophilic "backbone" groups (single monomer hydrophilic backbone) to number of hydrophobic "anchor" or tail groups.

When polymers having this criticality of hydrophilic to hydrophobic groups are added to the specific isotropic compositions, unexpectedly it has been found that the compositions are much more stable (i.e., clearer) compared to if the polymers not having this critical molar ratio (as well as addition of hydrotrope and electrolyte) had been added. While not wishing to be bound by theory, it is believed that the lower ratio of hydrophilic groups to hydrophobic backbone groups makes the overall polymer more hydrophobic, thereby allowing the polymers to more easily solubilize because of the hydrophobic interaction with the core of the surfactant micelles (which are hydrophobic), thereby in turn making a stable (i.e., clear) rather than hazy solution.

Use of a single monomer hydrophilic backbone group (i.e., acrylate) makes the molecule more soluble than a mixed monomer hydrophilic backbone.

Additionally, the amount and type of hydrotrope, the ratio of anionic to nonionic surfactants and salt concentration may govern the solubility of the polymer. Again, while not wishing to be bound by theory, nonionic hydrotropes, lower ratio of anionic to nonionic surfactants and higher electrolyte (encompassing both salts and builders) concentration tend to increase the solubility of the polymers by increasing the hydrophobicity of the micellar core and are therefore preferred. In fact, use of some hydrotropes and some electrolyte is required.

The isotropic liquids of the invention are set forth in greater detail below:

Detergent Active

The compositions of the invention contain one or more surface active agents selected from the group consisting of anionic, nonionic, cationic, ampholytic and zwitterionic surfactants or mixtures thereof. The preferred surfactant detergents for use in the present invention are mixtures of anionic and nonionic surfactants although it is to be understood that any surfactant may be used alone or in combination with any other surfactant or surfactants.

Anionic Surfactant Detergents

Anionic surface active agents which may be used in the present invention are those surface active compounds which contain a long chain hydrocarbon hydrophobic group in their molecular structure and a hydrophile group, i.e. water solubilizing group such as carboxylate, sulfonate or sulfate group or their corresponding acid form. The anionic surface active agents include the alkali metal (e.g. sodium and potassium) water soluble higher alkyl aryl sulfonates, alkyl sulfonates, alkyl sulfates and the alkyl poly ether sulfates. They may also include fatty acid or fatty acid soaps. One of the preferred groups of anionic surface active agents are the alkali metal, ammonium or alkanolamine salts of higher alkyl aryl sulfonates and alkali metal, ammonium or alkanolamine salts of higher alkyl sulfates. Preferred higher alkyl sulfates are those in which the alkyl groups contain 8 to 26 carbon atoms, preferably 12 to 22 carbon atoms and more preferably 14 to 18 carbon atoms. The alkyl group in the alkyl aryl sulfonate preferably contains 8 to 16 carbon atoms and more preferably 10 to 15 carbon atoms. A particularly preferred alkyl aryl sulfonate is the sodium potassium or ethanolamine $C_{10}$ to $C_{16}$ benzene sulfonate, e.g. sodium linear dodecyl benzene sulfonate. The primary and secondary alkyl sulfates can be made by reacting long chain alpha-olefins with sulfites or bisulfites, e.g. sodium bisulfite. The alkyl sulfonates can also be made by reacting long chain normal paraffin hydrocarbons with sulfur dioxide and oxygen as describe in U.S. Pat. Nos. 2,503,280, 2,507,088, 3,372,188 and 3,260,741 to obtain normal or secondary higher alkyl sulfates suitable for use as surfactant detergents.

The alkyl substituent is preferably linear, i.e. normal alkyl, however, branched chain alkyl sulfonates can be employed, although they are not as good with respect to biodegradability. The alkane, i.e. alkyl, substituent may be terminally sulfonated or may be joined, for example, to the 2-carbon atom of the chain, i.e. may be a secondary sulfonate. It is understood in the art that the substituent may be joined to any carbon on the alkyl chain. The higher alkyl sulfonates can be used as the alkali metal salts, such as sodium and potassium. The preferred salts are the sodium salts. The preferred alkyl sulfonates are the $C_{10}$ to $C_{18}$ primary normal alkyl sodium and potassium sulfonates, with the $C_{10}$ to $C_{15}$ primary normal alkyl sulfonate salt being more preferred.

Mixtures of higher alkyl benzene sulfonates and higher alkyl sulfates can be used as well as mixtures of higher alkyl benzene sulfonates and higher alkyl polyether sulfates.

The alkali metal or ethanolamine alkyl aryl sulfonate can be used in an amount of 0 to 70%, preferably 5 to 50% and more preferably 5 to 15% by weight.

The alkali metal or ethanolamine sulfate can be used in admixture with the alkylbenzene sulfonate in an amount of 0 to 70%, preferably 5 to 50% by weight.

Also normal alkyl and branched chain alkyl sulfates (e.g., primary alkyl sulfates) may be used as the anionic component.

The higher alkyl polyethoxy sulfates used in accordance with the present invention can be normal or branched chain alkyl and contain lower alkoxy groups which can contain two or three carbon atoms. The normal higher alkyl polyether sulfates are preferred in that they have a higher degree of biodegradability than the branched chain alkyl and the lower poly alkoxy groups are preferably ethoxy groups.

The preferred higher alkyl polyethoxy sulfates used in accordance with the present invention are represented by the formula:

$$R^1—O(CH_2CH_2O)_p—SO_3M,$$

where $R^1$ is $C_8$ to $C_{20}$ alkyl, preferably $C_{10}$ to $C_{18}$ and more preferably $C_{12}$ to $C_{15}$; p is 2 to 8, preferably 2 to 6, and more preferably 2 to 4; and M is an alkali metal, such as sodium and potassium, or an ammonium cation. The sodium and potassium salts are preferred.

A preferred higher alkyl poly ethoxylated sulfate is the sodium salt of a triethoxy $C_{12}$ to $C_{15}$ alcohol sulfate having the formula:

$$C_{12\text{-}15}—O—(CH_2CH_2O)_3—SO_3Na$$

Examples of suitable alkyl ethoxy sulfates that can be used in accordance with the present invention are $C_{12\text{-}15}$ normal or primary alkyl triethoxy sulfate, sodium salt; n-decyl diethoxy sulfate, sodium salt; $C_{12}$ primary alkyl diethoxy sulfate, ammonium salt; $C_{12}$ primary alkyl triethoxy sulfate, sodium salt; $C_{15}$ primary alkyl tetraethoxy sulfate, sodium salt; mixed $C_{14\text{-}15}$ normal primary alkyl mixed tri- and tetraethoxy sulfate, sodium salt; stearyl pentaethoxy sulfate, sodium salt; and mixed $C_{10\text{-}18}$ normal primary alkyl triethoxy sulfate, potassium salt.

The normal alkyl ethoxy sulfates are readily biodegradable and are preferred. The alkyl poly-lower alkoxy sulfates can be used in mixtures with each other and/or in mixtures with the above discussed higher alkyl benzene, sulfonates, or alkyl sulfates.

The alkali metal higher alkyl poly ethoxy sulfate can be used with the alkylbenzene sulfonate and/or with an alkyl sulfate, in an amount of 0 to 70%, preferably 5 to 50% and more preferably 5 to 20% by weight of entire composition.

Nonionic Surfactant

Nonionic surfactants which can be used with the invention, alone or in combination with other surfactants are described below.

As is well known, the nonionic surfactants are characterized by the presence of a hydrophobic group and an organic hydrophilic group and are typically produced by the condensation of an organic aliphatic or alkyl aromatic hydrophobic compound with ethylene oxide (hydrophilic in nature). Typical suitable nonionic surfactants are those disclosed in U.S. Pat. Nos. 4,316,812 and 3,630,929.

Usually, the nonionic surfactants are polyalkoxylated lipophiles wherein the desired hydrophile-lipophile balance is obtained from addition of a hydrophilic poly-lower alkoxy group to a lipophilic moiety. A preferred class of nonionic detergent is the alkoxylated alkanols wherein the alkanol is of 9 to 18 carbon atoms and wherein the number of moles of alkylene oxide (of 2 or 3 carbon atoms) is from 3 to 12. Of such materials it is preferred to employ those wherein the alkanol is a fatty alcohol of 9 to 11 or 12 to 15 carbon atoms and which contain from 5 to 8 or 5 to 9 alkoxy groups per mole.

Exemplary of such compounds are those wherein the alkanol is of 10 to 15 carbon atoms and which contain about 5 to 9 ethylene oxide groups per mole, e.g. Neodol 25-9 and Neodol 23-6.5, which products are made by Shell Chemical Company, Inc. The former is a condensation product of a mixture of higher fatty alcohols averaging about 12 to 15 carbon atoms, with about 9 moles of ethylene oxide and the latter is a corresponding mixture wherein the carbon atoms content of the higher fatty alcohol is 12 to 13 and the number of ethylene oxide groups present averages about 6.5. The higher alcohols are primary alkanols.

Another subclass of alkoxylated surfactants which can be used contain a precise alkyl chain length rather than an alkyl chain distribution of the alkoxylated surfactants described above. Typically, these are referred to as narrow range alkoxylates. Examples of these include the Neodol-1® series of surfactants manufactured by Shell Chemical Company.

Other useful nonionics are represented by the commercially well known class of nonionics sold under the trademark Plurafac by BASF. The Plurafacs are the reaction products of a higher linear alcohol and a mixture of ethylene and propylene oxides, containing a mixed chain of ethylene oxide and propylene oxide, terminated by a hydroxyl group. Examples include $C_{13}$–$C_{15}$ fatty alcohol condensed with 6 moles ethylene oxide and 3 moles propylene oxide, $C_{13}$–$C_{15}$ fatty alcohol condensed with 7 moles propylene oxide and 4 moles ethylene oxide, $C_{13}$–$C_{15}$ fatty alcohol condensed with 5 moles propylene oxide and 10 moles ethylene oxide or mixtures of any of the above.

Another group of liquid nonionics are commercially available from Shell Chemical Company, Inc. under the Dobanol or Neodol trademark: Dobanol 91-5 is an ethoxylated $C_9$–$C_{11}$ fatty alcohol with an average of 5 moles ethylene oxide and Dobanol 25-7 is an ethoxylated $C_{12}$–$C_{15}$ fatty alcohol with an average of 7 moles ethylene oxide per mole of fatty alcohol.

In the compositions of this invention, preferred nonionic surfactants include the $C_{12}$–$C_{15}$ primary fatty alcohols with relatively narrow contents of ethylene oxide in the range of from about 6 to 9 moles, and the $C_9$ to $C_{11}$ fatty alcohols ethoxylated with about 5–6 moles ethylene oxide.

Another class of nonionic surfactants which can be used in accordance with this invention are glycoside surfactants. Glycoside surfactants suitable for use in accordance with the present invention include those of the formula:

$$RO—R^1O—_y(Z)_x$$

wherein R is a monovalent organic radical containing from about 6 to about 30 (preferably from about 8 to about 18) carbon atoms; $R^1$ is a divalent hydrocarbon radical containing from about 2 to 4 carbons atoms; 0 is an oxygen atom; y is a number which can have an average value of from 0 to about 12 but which is most preferably zero; Z is a moiety derived from a reducing saccharide containing 5 or 6 carbon atoms; and x is a number having an average value of from 1 to about 10 (preferably from about 1½ to about 10).

A particularly preferred group of glycoside surfactants for use in the practice of this invention includes those of the formula above in which R is a monovalent organic radical (linear or branched) containing from about 6 to about 18 (especially from about 8 to about 18) carbon atoms; y is zero; z is glucose or a moiety derived therefrom; x is a number having an average value of from I to about 4 (preferably from about 1½ to 4).

Nonionic surfactants which may be used include polyhydroxy amides as discussed in U.S. Pat. No. 5,312,954 to Letton et al. and aldobionamides such as disclosed in U.S. Pat. No. 5,389,279 to Au et al., both of which are hereby incorporated by reference into the subject application.

Generally, nonionics would comprise 0–50% by wt., preferably 5 to 50%, more preferably 5 to 25% by wt. of the composition.

Mixtures of two or more of the nonionic surfactants can be used.

Cationic Surfactants

Many cationic surfactants are known in the art, and almost any cationic surfactant having at least one long chain alkyl group of about 10 to 24 carbon atoms is suitable in the present invention. Such compounds are described in "Cationic Surfactants", Jungermann, 1970, incorporated by reference.

Specific cationic surfactants which can be used as surfactants in the subject invention are described in detail in U.S. Pat. No. 4,497,718, hereby incorporated by reference.

As with the nonionic and anionic surfactants, the compositions of the invention may use cationic surfactants alone or in combination with any of the other surfactants known in the art. Of course, the compositions may contain no cationic surfactants at all.

Amphoteric Surfactants

Ampholytic synthetic surfactants can be broadly described as derivatives of aliphatic or aliphatic derivatives of heterocyclic secondary and tertiary amines in which the aliphatic radical may be straight chain or branched and wherein one of the aliphatic substituents contains from about 8 to 18 carbon atoms and at least one contains an anionic water-soluble group, e.g. carboxylate, sulfonate, sulfate. Examples of compounds falling within this definition are sodium 3-(dodecylamino)propionate, sodium 3-(dodecylamino)propane-1-sulfonate, sodium 2-(dodecylamino)ethyl sulfate, sodium 2-(dimethylamino) octadecanoate, disodium 3-(N-carboxymethyldodecylamino)propane 1-sulfonate, disodium octadecyl-imminodiacetate, sodium 1-carboxymethyl-2-undecylimidazole, and sodium N,N-bis(2-hydroxyethyl)-2-sulfato-3-dodecoxypropylamine. Sodium 3-(dodecylamino)propane-1-sulfonate is preferred.

Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. The cationic atom in the quaternary compound can be part of a heterocyclic ring. In all of these compounds there is at least one aliphatic group, straight chain or branched, containing from about 3 to 18 carbon atoms and at least one aliphatic substituent containing an anionic water-solubilizing group, e.g., carboxy, sulfonate, sulfate, phosphate, or phosphonate.

Specific examples of zwitterionic surfactants which may be used are set forth in U.S. Pat. No. 4,062,647, hereby incorporated by reference.

The amount of active used may vary from 1 to 85% by weight, preferably 10 to 50% by weight.

As noted the preferred surfactant systems of the invention are mixtures of anionic and nonionic surfactants.

Particularly preferred systems include, for example, mixtures of linear alkyl aryl sulfonates (LAS) and linear alkoxylated (e.g., ethoxylated) sulfates (AES) with alkoxylated nonionics for example in the ratio of 1:2:1 (i.e., 3:1 anionic to nonionic).

In one embodiment of the invention, applicants have increased the ratio of anionic (such as LAS or AES) relative to nonionic. While not wishing to be bound by theory, this appears to make the compositions less hydrophobic and, therefore, makes the compositions less stable (e.g., polymer won't dissolve as readily into micelles, perhaps because the micelles are less hydrophobic).

Preferably, the nonionic should comprise, as a percentage of an anionic/nonionic system, at least 20%, more preferably at least 25%, up to about 75% of the total surfactant system. A particularly preferred surfactant system comprises anionic:nonionic in a ratio of 3:1.

The compositions of the invention are all unstructured, isotropic compositions.

The detergent compositions of the invention are also preferably pH jump compositions. A pH jump heavy duty liquid (HDL) is a liquid detergent composition containing a system of components designed to adjust the pH of the wash liquor. To achieve the required pH regimes, a pH jump system can be employed in this invention to keep the pH of the product low for enzyme stability in multiple enzyme systems (e.g., protease and lipase systems) yet allow it to become moderately high in the wash for detergency efficacy. One such system is borax 10 $H_2O$/polyol. Borate ion and certain cis 1,2 polyols complex when concentrated to cause a reduction in pH. Upon dilution, the complex dissociates, liberating free borate to raise the pH. Examples of polyols which exhibit this complexing mechanism with borax include catechol, galacitol, fructose, sorbitol and pinacol. For economic reasons, sorbitol is the preferred polyol.

Sorbitol or equivalent component (i.e., 1,2 polyols noted above) is used in the pH jump formulation in an amount from about 1 to 25% by wt., preferably 3 to 15% by wt. of the composition.

Borate or boron compound is used in the pH jump composition in an amount from about 0.5 to 10.0% by weight of the composition, preferably 1 to 5% by weight.

Hydrotropes

Another ingredient required by the subject invention is hydrotropes. In general, addition of hydrotropes helps to incorporate higher levels of surfactants into isotropic liquid detergents than would otherwise be possible due to phase separation of surfactants from the aqueous phase. Hydrotropes also allow a change in the proportions of different types of surfactants, namely anionic, nonionic, cationic and zwitterionic, without encountering the problem of phase separation. Thus, they increase the formulation flexibility. Hydrotropes function through either of the following mechanisms: i) they increase the solubility of the surfactant in the aqueous phase by changing the solvent power of the aqueous phase; short chain alcohols such as ethanol,isopropanol and also glycerol and propylene glycol are examples in this class and ii) they prevent formation of liquid crystalline phases of surfactants by disrupting the packing of the hydrocarbon chains of the surfactants in the micelles; alkali metal salts of alkyl aryl sulfonates such as xylene sulfonate, cumene sulfonate and alkyl aryl disulfonates such as DOWFAX® family of hydrotropes marketed by Dow Chemicals are examples in this class.

Although normally hydrotropes of the second group mentioned (Group II) would be expected to increase solubility of polymer, it was unexpectedly found that addition of alkyl aryl sulfonates at concentrations usually used in liquid detergents (~1 to 15 weight percent) caused a decrease in the solubility of the hydrophobically modified polymers of the present invention. While not wishing to be bound by theory, applicants believe that these Group II hydrotropes actually tend to decrease the hydrophobicity of the core of the surfactant micelles, thereby decreasing the interaction between the hydrophobic groups of the hydrophobically modified polymer and the micelle. Thus, the more weight efficient the hydrotrope (i.e., this second class of hydrotropes) the larger is the decrease in the hydrophobicity of the micelles and, as a consequence, the lower the solubility of the hydrophobically modified polymer. Thus, a more weight efficient hydrotrope (e.g., a hydrotrope such as cumene sulfonate which, for a given surfactant system, is a better hydrotrope) decreases the solubility of the polymer while a less weight efficient hydrotrope (e.g., xylene sulfonate) increases the solubility.

In other words, while intuitively one of ordinary skill in the art would prefer the weight efficient hydrotropes of Class II above, the preferred hydrotropes of this invention are the less weight efficient, but solubility enhancing, hydrotropes of Class I.

Preferred hydrotropes in the compositions .of the present invention are polyols, which may also act as enzyme stabilizers, such as propylene glycol, ethylene glycol, glycerol, sorbitol, mannitol and glucose.

These would not traditionally be considered good hydrotropes but, as noted above, these compounds do not decrease the hydrophobicity of the micelles as much thereby allowing hydrophobically modified polymers to solubilize better.

In general, hydrotropes should be present in an amount of 0.1% to 25% by wt., preferably about 1% to 25% by wt., more preferably 1% to 15% by wt., most preferably 1% to 10% by wt. of the composition. If the hydrotrope is alkyl aryl sulfonate, preferably it should be present in an amount less than 2.5% by wt. of the composition.

Builders/Electrolytes

Builders which can be used according to this invention include conventional alkaline detergency builders, inorganic or organic, which should be used at levels from about 0.1% to about 20.0% by weight of the composition, preferably from 1.0% to about 10.0% by weight, more preferably 2% to 5% by weight.

As electrolyte may be used any water-soluble salt. Electrolyte may also be a detergency builder, such as the inorganic builder sodium tripolyphosphate, or it may be a non-functional electrolyte such as sodium sulphate or chloride. Preferably the inorganic builder comprises all or part of the electrolyte. That is the term electrolyte encompasses both builders and salts.

Examples of suitable inorganic alkaline detergency builders which may be used are water-soluble alkalimetal phosphates, polyphosphates, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroxyethyl)-nitrilodiacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1-diphosphonic acid; sodium, potassium and lithium salts of methylene diphosphonic acid; sodium, potassium and lithium salts of ethylene diphosphonic acid; and sodium, potassium and lithium salts of ethane-1,1,2-triphosphonic acid. Other examples include the alkali metal salts of ethane-2-carboxy-1,1-diphosphonic acid hydroxymethanediphosphonic acid, carboxyldiphosphonic acid, ethane-1-hydroxy-1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water-soluble salts of polycarboxylate polymers and copolymers as described in U.S. Pat. No 3,308,067.

In addition, polycarboxylate builders can be used satisfactorily, including water-soluble salts of mellitic acid, citric acid, and carboxymethyloxysuccinic acid, salts of polymers of itaconic acid and maleic acid, tartrate monosuccinate, tartrate disuccinate and mixtures thereof (TMS/TDS).

Certain zeolites or aluminosilicates can be used. One such aluminosilicate which is useful in the compositions of the invention is an amorphous water-insoluble hydrated compound of the formula $Na_x(_yAlO_2.SiO_2)$, wherein x is a number from 1.0 to 1.2 and y is 1, said amorphous material being further characterized by a Mg++ exchange capacity of from about 50 mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_z[(AlO_2)_y.(SiO_2)]xH_2O$, wherein z and y are integers of at least 6; the molar ratio of z to y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grains/gallon/minute/gram. These synthetic aluminosilicates are more fully described in British Patent No. 1,429,143.

In general, the more electrolyte that is used, the more hydrophobic are the micelles and, according to what applicants believe to be the theoretical mechanism of the invention, the better for the hydrophobically modified polymer to dissolve.

Enzymes

One or more enzymes as described in detail below, may be used in the compositions of the invention.

If a lipase is used, the lipolytic enzyme may be either a fungal lipase producible by *Humicola lanuginosa* and *Thermomyces lanuginosus*, or a bacterial lipase which show a positive immunological cross-reaction with the antibody of the lipase produced by the microorganism *Chromobacter viscosum* var. lipolyticum NRRL B-3673. This microorganism has been described in Dutch patent specification 154, 269 of Toyo Jozo Kabushiki Kaisha and has been deposited with the Fermentation Research Institute, Agency of Industrial Science and Technology, Ministry of International Trade and Industry, Tokyo, Japan, and added to the permanent collection under nr. KO Hatsu Ken Kin Ki 137 and is available to the public at the United States Department of Agriculture, Agricultural Research Service, Northern Utilization and Development Division at Peoria, Ill., USA, under the nr. NRRL B-3673. The lipase produced by this microorganism is commercially available from Toyo Jozo Co., Tagata, Japan, hereafter referred to as "TJ lipase". These bacterial lipases should show a positive immunological cross-reaction with the TJ lipase antibody, using the standard and well-known immunodiffusion procedure according to Ouchterlony (Acta. Med. Scan., 133, pages 76–79 (1950).

The preparation of the antiserum is carried out as follows:

Equal volumes of 0.1 mg/ml antigen and of Freund's adjuvant (complete or incomplete) are mixed until an emulsion is obtained. Two female rabbits are injected with 2 ml samples of the emulsion according to the following scheme:

day 0: antigen in complete Freund's adjuvant day 4: antigen in complete Freund's adjuvant day 32: antigen in incomplete Freund's adjuvant day 60: booster of antigen in incomplete Freund's adjuvant The serum containing the required antibody is prepared by centrifugation of clotted blood, taken on day 67.

The titre of the anti-TJ-lipase antiserum is determined by the inspection of precipitation of serial dilutions of antigen and antiserum according to the Ouchterlony procedure. A $2^5$ dilution of antiserum was the dilution that still gave a visible precipitation with an antigen concentration of 0.1 mg/ml.

All bacterial lipases showing a positive immunological cross-reaction with the TJ-lipase antibody as hereabove described are lipases suitable in this embodiment of the invention. Typical examples thereof are the lipase ex *Pseudomonas fluorescens* IAM 1057 available from Amano Pharmaceutical Co., Nagoya, Japan, under the trade-name Amano-P lipase, the lipase ex *Pseudomonas fragi* FERM P 1339 (available under the trade-name Amano-B), the lipase ex *Pseudomonas nitroreducens* var. lipolyticum FERM P1338, the lipase ex *Pseudomonas sp.* available under the trade-name Amano CES, the lipase ex *Pseudomonas cepacia*, lipases ex *Chromobacter viscosum*, e.g. *Chromobacter viscosum* var. lipolyticum NRRL B-3673, commercially available from Toyo Jozo Co., Tagata, Japan; and further *Chromobacter viscosum* lipases from U.S. Biochemical Corp. USA and Diosynth Co., The Netherlands, and lipases ex *Pseudomonas gladioli*.

An example of a fungal lipase as defined above is the lipase ex *Humicola lanuginosa*, available from Amano under the tradename Amano CE; the lipase ex *Humicola lanuginosa* as described in the aforesaid European Patent Application 0.258,068 (NOVO), as well as the lipase obtained by cloning the gene from *Humicola lanuginosa* and expressing this gene in *Aspergillus oryzae*, commercially available from NOVO industri A/S under the tradename "Lipolase". This lipolase is a preferred lipase for use in the present invention.

While various specific lipase enzymes have been described above, it is to be understood that any lipase which can confer the desired lipolytic activity to the composition may be used and the invention is not intended to be limited in any way by specific choice of lipase enzyme.

The lipases of this embodiment of the invention are included in the liquid detergent composition in such an amount that the final composition has a lipolytic enzyme activity of from 100 to 0.005 LU/ml in the wash cycle, preferably 25 to 0.05 LU/ml when the formulation is dosed at a level of about 0.1–10, more preferably 0.5–7, most preferably 1–2 g/liter.

A Lipase Unit (LU) is that amount of lipase which produces 1/μmol of titratable fatty acid per minute in a pH stat under the following conditions: temperature 30° C.; pH=9.0; substrate is an emulsion of 3.3 wt.% of olive oil and 3.3% gum arabic, in the presence of 13 mmol/l $Ca^{2+}$ and 20 mmol/l NaCl in 5 mmol/l Tris-buffer.

Naturally, mixtures of the above lipases can be used. The lipases can be used in their non-purified form or in a purified form, e.g. purified with the aid of well-known absorption methods, such as phenyl sepharose absorption techniques.

If a protease is used, the proteolytic enzyme can be of vegetable, animal or microorganism origin. Preferably, it is of the latter origin, which includes yeasts, fungi, molds and bacteria. Particularly preferred are bacterial subtilisin type proteases, obtained from e.g. particular strains of *B. subtilis* and *B licheniformis*. Examples of suitable commercially available proteases are Alcalase, Savinase, Esperase, all of NOVO Industri a/S; Maxatase and Maxacal of Gist-Brocades; Kazusase of Showa Denko; BPN and BPN' proteases; Optimase from Solvay and so on. The amount of proteolytic enzyme, included in the composition, ranges from 0.05–50,000 GU/mg. preferably 0.1 to 50 GU/mg, based on the final composition. Naturally, mixtures of different proteolytic enzymes may be used.

While various specific enzymes have been described above, it is to be understood that any protease which can confer the desired proteolytic activity to the composition may be used and this embodiment of the invention is not limited in any way be specific choice of proteolytic enzyme.

In addition to lipases or proteases, it is to be understood that other enzymes such as cellulases, oxidases, amylases, peroxidases and the like which are well known in the art may also be used with the composition of the invention. The enzymes may be used together with co-factors required to promote enzyme activity, i.e., they may be used in enzyme systems, if required. It should also be understood that enzymes having mutations at various positions (e.g., enzymes engineered for performance and/or stability enhancement) are also contemplated by the invention. One example of an engineered commercially available enzyme is Durazym® from Novo.

The enzyme stabilization system may comprise calcium ion; boric acid, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected sos that there is always some minimum level available for the enzyme after allowing for complexation with builders, etc., in the composition. Any water-soluble calcium salt can be used as the source of calcium ion, including calcium chloride, calcium formate, calcium acetate and calcium propionate. A small amount of calcium ion, generally from about 0.05 to about 2.5 millimoles per liter, is often also present in the composition due to calcium in the enzyme slurry and formula water.

Another enzyme stabilizer which may be used in propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propane diol which is preferred), ethylene glycol, glycerol, sorbitol, mannitol and glucose. The polyol generally represents from about 0.1 to 25% by weight, preferably about 1.0% to about 15%, more preferably from about 2% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g., sodium ortho-, meta- and pyroborate and sodium pentaborate) are suitable. Substituted boric acids (e.g., phenylboronic acid, butane boronic acid and a p-bromo phenylboronic acid) can also be used in place of boric acid.

One preferred stabilization system is a polyol in combination with boric acid. Preferably, the weight ratio of polyol to boric acid added is at least 1, more preferably at least about 1.3.

Another preferred stabilization system is the pH jump system such as is taught in U.S. Pat. No. 5,089,163 to Aronson et al., hereby incorporated by reference into the subject application.

Optional Ingredients

In addition to the enzymes mentioned above, a number of other optional ingredients may be used.

Alkalinity buffers which may be added to the compositions of the invention include monoethanolamine, triethanolamine, borax and the like.

Other materials such as clays, particularly of the water-insoluble types, may be useful adjuncts in compositions of this invention. Particularly useful is bentonite. This material is primarily montmorillonite which is a hydrated aluminum silicate in which about ⅙ th of the aluminum atoms may be replaced by magnesium atoms and with which varying amounts of hydrogen, sodium, potassium, calcium, etc. may be loosely combined. The bentonite in its more purified form (i.e. free from any grit, sand, etc.) suitable for detergents contains at least 50% montmorillonite and thus its cation exchange capacity is at least about 50 to 75 meq per 100 g of bentonite. Particularly preferred bentonites are the Wyoming or Western U.S. bentonites which have been sold as Thixo-jels 1, 2, 3 and 4 by Georgia Kaolin Co. These bentonites are known to soften textiles as described in British Patent No. 401,413 to Marriott and British Patent No. 461,221 to Marriott and Guam.

In addition, various other detergent additives or adjuvants may be present in the detergent product to give it additional desired properties, either of functional or aesthetic nature.

Improvements in the physical stability and anti-settling properties of the composition may be achieved by the addition of a small effective amount of an aluminum salt of a higher fatty acid, e.g., aluminum stearate, to the composition. The aluminum stearate stabilizing agent can be added in an amount of 0 to 3%, preferably 0.1 to 2.0% and more preferably 0.5 to 1.5%.

There also may be included in the formulation, minor amounts of soil suspending or anti-redeposition agents, e.g. polyvinyl alcohol, fatty amides, sodium carboxymethyl cellulose, hydroxy-propyl methyl cellulose. A preferred anti-redeposition agent is sodium carboxylmethyl cellulose having a 2:1 ratio of CM/MC which is sold under the tradename Relatin DM 4050.

Optical brighteners for cotton, polyamide and polyester fabrics can be used. Suitable optical brighteners include Tinopal LMS-X, stilbene, triazole and benzidine sulfone compositions, especially sulfonated substituted triazinyl stilbene, sulfonated naphthotriazole stilbene, benzidene sulfone, etc., most preferred are stilbene and triazole combinations. A preferred brightener is Stilbene Brightener N4 which is a dimorpholine dianilino stilbene sulfonate.

Anti-foam agents, e.g. silicon compounds, such as Silicane L 7604, can also be added in small effective amounts.

Bactericides, e.g. tetrachlorosalicylanilide and hexachlorophene, fungicides, dyes, pigments (water dispersible), preservatives, e.g. formalin, ultraviolet absorbers, anti-yellowing agents, such as sodium carboxymethyl cellulose, pH modifiers and pH buffers, color safe bleaches, perfume and dyes and bluing agents such as Iragon Blue L2D, Detergent Blue 472/572 and ultramarine blue can be used.

Also, soil release polymers and cationic softening agents may be used.

Polymer

The polymer of the invention is one which, as noted above, has previously been used in structured (i.e., lamellar) compositions such as those described in U.S. Pat. No. 5,147,576 to Montague et al., hereby incorporated by reference into the subject application. This is because the polymer allows the incorporation of greater amounts of surfactants and/or electrolytes than would otherwise be compatible with the need for a stable, low-viscosity product as well as the incorporation, if desired, of greater amounts of other ingredients to which lamellar dispersions are highly stability-sensitive.

In general, the polymer comprises a "backbone" component which is a monomer (single monomer) as discussed below and a "tail" portion which is a second monomer which is hydrophobic in nature (e.g., lauryl methacrylate or styrene).

The hydrophilic backbone generally is a linear, branched or highly cross-linked molecular composition containing one type of relatively hydrophobic monomer unit wherein the monomer is preferably sufficiently soluble to form at least a 1% by weight solution when dissolved in water. The only limitation to the structure of the hydrophilic backbone is that a polymer corresponding to the hydrophilic backbone made from the backbone monomeric constituents is relatively water soluble (solubility in water at ambient temperature and at pH of 3.0 to 12.5 is preferably more than 1 g/l). The hydrophilic backbone is also preferably predominantly linear, e.g., the main chain of backbone constitutes at least 50% by weight, preferably more than 75%, most preferably more than 90% by weight.

The hydrophilic backbone is composed of one monomer unit selected from a variety of units available for polymer preparation and linked by any chemical links including

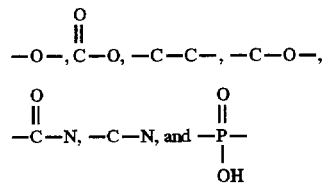

The "tail" group comprises a monomer unit comprising hydrophobic side chains which are incorporated in the "tail" monomer. The polymer is made by copolymerizing hydrophobic monomers (tail group comprising hydrophobic groups) and the hydrophilic monomer making up the backbone. The hydrophobic side chains preferably include those which when isolated from their linkage are relatively water insoluble, i.e., preferably less than 1 g/l, more preferred less than 0.5 g/l, most preferred less than 0.1 g/l of the hydrophobic monomers, will dissolve in water at ambient temperature at pH of 3.0 to 12.5.

Preferably, the hydrophobic moieties are selected from siloxanes, saturated and unsaturated alkyl chains, e.g., having from 5 to 24 carbons, preferably 6 to 18, most preferred 8 to 16 carbons, and are optionally bonded to hydrophilic backbone via an alkoxylene or polyalkoxylene linkage, for example a polyethoxy, polypropoxy, or butyloxy (or mixtures of the same) linkage having from 1 to 50 alkoxylene groups. Alternatively, the hydrophobic side chain can be composed of relatively hydrophobic alkoxy groups, for example, butylene oxide and/or propylene oxide, in the absence of alkyl or alkenyl groups. Another preferred hydrophobic group include styrene.

Monomer units which make up the hydrophilic backbone include:

(1) unsaturated, preferably mono-unsaturated, $C_{1-6}$ acids, ethers, alcohols, aldehydes, ketones or esters such as monomers of acrylic acid, methacrylic acid, maleic acid, vinyl-methyl ether, vinyl sulphonate or vinylalcohol obtained by hydrolysis of vinyl acetate, acrolein;

(2) cyclic units, unsaturated or comprising other groups capable of forming inter-monomer linkages, such as saccharides and glucosides, alkoxy units and maleic anhydride;

(3) glycerol or other saturated polyalcohols.

Monomeric units comprising both the hydrophilic backbone and hydrophobic side chain may be substituted with groups such as amino, amine, amide, sulphonate, sulphate, phosphonate, phosphate, hydroxy, carboxyl and oxide groups.

The hydrophilic backbone is composed of one unit. The backbone may also contain small amounts of relatively hydrophilic units such as those derived from polymers having a solubility of less than 1 g/l in water provided the overall solubility of the polymer meets the requirements discussed above. Examples include polyvinyl acetate or polymethyl methacrylate.

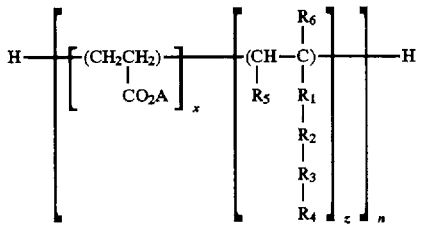

wherein z is 1;

x:z (i.e., hydrophilic backbone to hydrophobic tail) is less than 20, preferably less than 17, more preferably less than 10;

in which the monomer units may be in random order; and n is at least 1:

$R_1$ represents —CO—O—, —O—, —O—CO—, —$CH_2$—, —CO—NH— or is absent;

$R_2$ represents from 1 to 50 independently selected alkyleneoxy groups preferably ethylene oxide or propylene oxide groups, or is absent, provided that when $R_3$ is absent and $R_4$ represents hydrogen or contains no more than 4 carbon atoms, then $R_2$ must contain an alkyleneoxy group with at least 3 carbon atoms;

$R_3$ represents a phenylene linkage, or is absent;

$R_4$ represents hydrogen or a $C_{1-24}$ alkyl or ($C_{2-24}$ alkenyl group, with the provisos a) when $R_1$ represents —O—CO—, $R_2$ and $R_3$ must be absent and $R_4$ must contain at least 5 carbon atoms;

b) when $R_2$ is absent, $R_4$ is not hydrogen and when $R_3$ is absent, then $R_4$ must contain at least 5 carbon atoms;

$R_5$ represents hydrogen or a group of formula —COOA;

$R_6$ represents hydrogen or C1–4 alkyl; and A is independently selected from hydrogen, alkali metals, alkaline earth metals, ammonium and amine bases and $C_{1-4}$.

Alternatively, the

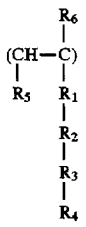

group (defined by z) can be substituted benzene group such as, for example styrene.

The present invention is directed to the observation that, when polymers such as those described above (known as deflocculating or decoupling polymers in the "structured liquid" art) are used in isotropic liquids and further when there is a criticality of hydrophilic groups to hydrophobic groups, (as well as required hydrotrope and electrolyte levels; and preferred hydrotropes and surfactants used) the liquids are far more stable (i.e., they do not phase separate and become hazy, but rather stay clear) than if these required or preferred variables had not been met.

More particularly, when the molar ratio of hydrophilic to hydrophobic monomer is less than about 20 (i.e., 0 to 20), preferably less than about 10 (i.e., 0.5 to 10), most preferably, less than about 7 to about 1 (i.e., preferably greater than or equal to 1 ), an isotropic liquid which would otherwise be unstable (less clear) hazy becomes clear. Minimal amounts of hydrotrope and electrolytes are required. Although applicants have not achieved optimal clarity except wherein the molar ratio was below about 10, it is possible to achieve such clarity when conditions are appropriately manipulated.

While not wishing to be bound by theory, it is believed that there is a dependence on the hydrophobicity (which is related to the charge density) of the micelles which is governed by the type of surfactant and hydrotrope system used, as well as the electrolyte level. Higher anionic to nonionic ratios of surfactants (higher LAS or AES vs. alcohol ethoxylate) as well as hydrotropes (higher cumene sulfonate versus propylene glycol) tend to make the micelle less hydrophobic (more charged) thereby reducing the solubility of the hydrophobically modified polymer. Furthermore, decreasing the salt level increases the charge on the micelle (by providing less counter ions to neutralize the charge on the micelles) thereby making it more hydrophilic and in turn reducing the solubility of the polymer.

The polymer should be used in an amount comprising 0.1 to 10% by wt., preferably 0.25% to 5% by wt. of the composition.

The following examples are intended to clarify the invention further and are not intended to limit the invention in any way.

All percentages are intended to be percentages by weight, unless stated otherwise.

Materials

Surfactants: Linear alkylbenzene sulfonic acid (LAS acid) was purchased from Vista Chemicals; alcohol ethoxy sulfate (AES Neodol 25-3S) and ethoxylated alcohols (Neodol 25-9) were purchased from Shell Chemicals.

Polymers: Hydrophobically modified acrylate/lauryl methacrylate based polymers (decoupling polymers) of different molecular weights and containing different ratios of hydrophobic groups with tails per molecule were synthesized and characterized at National Starch and Chemicals; and hydrophobically modified acrylate styrene based polymers such as H100 and H1200 from National Starch and Chemicals.

Hydrotropes: Sodium Cumene sulfonate (SCS) and sodium xylene sulfonate (SXS) were supplied by Stepan Chemicals and propylene glycol was purchased from Fisher Scientific.

Other Reagents: Sorbitol was supplied as a 70 wt.% aqueous solution by ICI Americas, sodium borate 10 aq., sodium citrate 2 aq. and glycerol were purchased from Fisher Scientific.

Methods: The formulations were prepared by adding to water, sodium citrate, sorbitol, borate, hydrotrope and sodium hydroxide in a beaker and stirred at 35°–50° C. until the solution became clear. This was followed by the addition of LAS acid and Neodol 25-9. The mixture was then cooled to 25° C. and the desired amount of Neodol 25-3S (59% AES) was added. Required amount of polymer was then added to the base formulation at room temperature (18°–23° C.).

The following base formulation was used in the examples of the invention.

Base Formulation

| Component | Wt. % | Remarks |
|---|---|---|
| Sodium alkyl benzene sulfonate (LAS) | 2.6–23.0 | Anionic surfactant |
| Alcohol ethoxy sulfate $C_{12}$– | 2.6–23.0 | Anionic surfactant |

-continued

| Base Formulation | | |
|---|---|---|
| Component | Wt. % | Remarks |
| $C_{15}$, 3EO (AES) | | |
| Alcohol ethoxylate $C_{12}$–$C_{15}$, 9EO | 2.6–23.0 | Nonionic surfactant |
| Sodium citrate 2 aq. | 0–5.0 | Builder |
| Sodium borate 10 aq. | 4.0 | Enzyme stabilizer |
| Sorbitol (70% active) | 6.4 | Enzyme stabilizer |
| Glycerol | 2.7 | Enzyme stabilizer |
| Propylene glycol/cumene sulfonate/xylene sulfonate | 1.0–4.0 | Hydrotrope |
| Polymer (hydrophobically modified)* | 0.0–2.0 | Anti-redeposition agent |
| Deionized water | Balance | |

Notes: i) Total surfactants concentration = 28 to 30 wt. %
(ii) See U.S. Pat. No. 5,089,163 to Aronson et al., for example, hereby incorporated by reference into the subject application, with regard to enzyme stabilization.
*acrylate/lauryl methacrylate polymer having varying molecular weights.

EXAMPLE 1

Solubility of Hydrophobically Modified Polymers in Base Formulation Containing 2.5 wt.% Citrate; Propylene Glycol; and LAS, LES and Neodol 25-9 in the Ratio of 1:2:1.

| Polymer | Hydrophobic Anchors/ Molecular | MW Daltons | Molar ratio of backbone group (e.g., acrylate) to monomer with tail group (e.g., lauryl methacrylate) | Concn. Wt. % | Appearance |
|---|---|---|---|---|---|
| Decoupling Polymer* | 0.9 | 9150 | 105.4 | 0.78 | Hazy |
| | | | | 1.30 | Hazy |
| Decoupling Polymer | 2.0 | 7500 | 37.2 | 1.0 | Hazy |
| Decoupling Polymer | 1.3 | 3800 | 28.4 | 1.00 | Hazy |
| Decoupling Polymer | 1.8 | 3560 | 18.3 | 0.9 | Hazy |
| | | | | 1.5 | Hazy |
| Decoupling Polymer | 3.4 | 6100 | 16.4 | 0.83 | Hazy |
| | | | | 1.38 | Hazy |
| Decoupling Polymer | 2.8 | 2370 | 6.3 | 0.99 | Clear |
| | | | | 1.65 | Clear |

*Acrylate/lauryl methacrylate

This example shows that the clarity of the liquid depends on the molar ratio between the number of hydrophilic backbone monomers and hydrophobic tail groups (also attached to monomers). Polymer having a ratio below 10, preferably below 7, produce clear liquid while those having a ratio above 20 produce a hazy liquid. The lower the value of the above defined molar ratio, more hydrophobic is the polymer. While not wishing to be bound by theory, it is believed that polymers that are more hydrophobic produce clear liquids because they are more easily solubilized due to hydrophobic interaction with the core of the surfactant micelles, which are also hydrophobic.

EXAMPLE 2

Solubility of Hydrophobically Modified Polymers in Base Formulation Same as Example 1, but Containing 3.75 wt. % Citrate

| Polymer | Hydrophobic Anchors/ Molecular | MW Daltons | Molar ratio of backbone group (e.g., acrylate) to monomer with tail group (e.g., lauryl methacrylate) | Concn. Wt. % | Appearance |
|---|---|---|---|---|---|
| Decoupling Polymer | 0.9 | 9150 | 105.4 | 0.78 | Hazy |
| | | | | 1.30 | Hazy |
| Decoupling Polymer | 2.0 | 7500 | 37.2 | 0.75 | Hazy |
| | | | | 1.25 | Hazy |
| Decoupling Polymer | 1.3 | 3800 | 28.4 | 1.00 | Hazy |
| | | | | 1.67 | Hazy |
| Decoupling Polymer | 1.8 | 3560 | 18.3 | 0.9 | Hazy |
| | | | | 1.5 | Hazy |
| Decoupling Polymer | 3.4 | 6100 | 16.4 | 0.83 | Hazy |
| | | | | 1.38 | Hazy |
| Decoupling Polymer | 2.8 | 2370 | 6.3 | 0.99 | Clear |
| | | | | 1.65 | Clear |

As in Example 1, the clarity of the liquid depends on the ratio between the number of hydrophilic backbone monomers and hydrophobic tail groups. As in formulations containing only 2.5 weight sodium citrate 2 aq., in formulations containing 3.75 wt.% sodium citrate polymer having hydrophilic to tail ratio below 10, preferably below 7 are clear, and, those above 10 are unclear.

EXAMPLE 3

Solubility of Hydrophobically Modified Polymers in Base Formulation Containing 2.5 wt.% Citrate and Cumene Sulfonate ("classic" hydrotrope); and LAS, LES and Neodol in ratio of 1:2:1

| Polymer | Hydrophobic Anchors/ Molecular | MW Daltons | Molar ratio of backbone group (e.g., acrylate) to monomer with tail group (e.g., lauryl methacrylate) | Concn. Wt. % | Appearance 4 Wt. % | 2.5% SCS | 1% SCS |
|---|---|---|---|---|---|---|---|
| Decoupling | 0.9 | 9150 | 105.4 | 0.78 | Hazy | | |
| Polymer | | | | 1.30 | Hazy | | |
| Decoupling | 1.3 | 3800 | 28.4 | 1.00 | Hazy | | |
| Polymer | | | | 1.67 | Hazy | | |
| Decoupling | 1.8 | 3560 | 18.3 | 0.9 | Hazy | | |
| Polymer | | | | 1.5 | Hazy | | |
| Decoupling | 3.4 | 6100 | 16.4 | 0.83 | Hazy | | |
| Polymer | | | | 1.38 | Hazy | | |
| Decoupling | 2.8 | 2370 | 6.3 | 0.99 | Hazy | Hazy | Clear |
| Polymer | | | | 1.65 | Hazy | Hazy | Clear |

In formulations containing cumene sulfonate rather than propylene glycol (compare to Example 1) polymers having a molar ratio between number of hydrophilic backbone monomers and number of hydrophobic tail groups per molecule of less than 20, preferably less than 17) produce an unstable/hazy liquid above a cumene sulfonate concentration of 1.0 wt.%. It should be noted that in formulation containing 2.5 wt.% sodium citrate, 2 aq. and propylene glycol (instead of cumene sulfonate, see Example polymer having the above defined ratio value of below 10, preferably below 7 produced a clear liquid. This is believed to be true because the core of the micelles formed in the presence of cumene sulfonate are less hydrophobic than those formed in presence of propylene glycol. Thus propylene glycol is preferred.

EXAMPLE 4

Solubility of Hydrophobically Modified Polymers in Base Formulation Containing 2.5 wt.% Citrate, Xylene Sulfonate (SXS); and LAS, LES and Neodol in ratio of 1:2:1

| Polymer | Hydrophobic Anchors/ Molecular | MW Daltons | Molar ratio of backbone group (e.g., acrylate) to monomer with tail group (e.g., lauryl methacrylate) | Concn. Wt. % | Appearance 4 wt. % SXS | 2.5 wt % SXS | 1 wt. % SXS |
|---|---|---|---|---|---|---|---|
| Decoupling | 0.9 | 9150 | 105.4 | 0.78 | Hazy | | |
| Polymer | | | | 1.30 | Hazy | | |
| Decoupling | 1.3 | 3800 | 28.4 | 1.00 | Hazy | | |
| Polymer | | | | 1.67 | Hazy | | |
| Decoupling | 1.8 | 3560 | 18.3 | 0.9 | Hazy | | |
| Polymer | | | | 1.5 | Hazy | | |
| Decoupling | 3.4 | 6100 | 16.4 | 0.83 | Hazy | | |
| Polymer | | | | 1.38 | Hazy | | |
| Decoupling | 2.8 | 2370 | 6.3 | 0.99 | Hazy | Clear | Clear |
| Polymer | | | | 1.65 | Hazy | Hazy | Clear |

In the case of xylene sulfonate instead of cumene sulfonate (compare Example 3), the composition began to clarify even at 2.5 wt.% xylene sulfonate.

While not wishing to be bound by theory, this is believed to be because cumene sulfonate being a more "weight efficient" hydrotrope (i.e., better hydrotrope), actually acts to make the solution less hydrophobic. This in turn results in poorer solubility because the hydrophobically modified polymer prefers greater hydrophobicity. The xylene sulfonate, being less efficient, keeps the solution more hydrophobic and, therefore, makes polymer more soluble.

EXAMPLE 5

Solubility of Hydrophobically Modified Polymers in Base Formulation Containing Propylene glycol and LAS,LES and Neodol 25 in the ratio of 1:2:1

Polymer: Decoupling type of MW=2370 Daltons; Hydrophobic Anchors/Molecule=2.8; Hydrophilic Backbone: tail=6.3

| Citrate Concentration Wt. % | Appearance |
|---|---|
| 0.0 | Hazy |
| 2.5 | Clear |
| 3.75 | Clear |

This example is to show that, if no electrolyte (citrate) had been used in Examples 1 and 2 (2.5% & 3.75% by wt. used respectively in these examples), then the composition would have been hazy (i.e., polymers not dissolve therein).

Thus, the example shows that some electrolyte is required.

EXAMPLE 6

Solubility of Hydrophobically Modified Polymers in Base Formulation Containing Propylene Glycol, 0.0 wt.% Citrate and LAS, AES and Neodol 25-9 in the Ratio of 1:1:8

| Polymer | Hydrophobic Anchors/ Molecule | MW Daltons | Concn. Wt. % | Appearance |
|---|---|---|---|---|
| Decoupling Polymer | 0.9 | 9150 | 0.78 | Hazy |
| | | | 1.30 | Hazy |
| Decoupling Polymer | 2.0 | 7500 | 0.75 | Hazy |
| | | | 1.25 | Hazy |

-continued

| Polymer | Hydrophobic Anchors/ Molecule | MW Daltons | Concn. Wt. % | Appearance |
|---|---|---|---|---|
| Decoupling Polymer | 1.3 | 3800 | 1.00 | Hazy |
| | | | 1.67 | Hazy |
| Decoupling Polymer | 1.8 | 3560 | 0.9 | Hazy |
| | | | 1.5 | Hazy |

-continued

| Polymer | Hydrophobic Anchors/ Molecule | MW Daltons | Concn. Wt. % | Appearance |
|---|---|---|---|---|
| Decoupling Polymer | 3.4 | 6100 | 0.83 | Hazy |
| | | | 1.38 | Hazy |
| Decoupling Polymer | 2.8 | 2370 | 0.99 | Clear |
| | | | 1.65 | Hazy |

This example shows that when ratio of nonionic is increased, then clarity can be obtained even where it would not otherwise be possible.

While not wishing to be bound by theory, this is believed to be because compositions with high levels of nonionic are more hydrophobic than compositions with high levels of anionic. This in turn makes hydrophobically modified polymer more soluble.

EXAMPLE 7

Solubility of Hydrophobically Modified Polymers in Base Formulation Containing Propylene Glycol, 0.0 wt.% Citrate and LAS,LES and Neodol 25-9 in the Ratio 8:1:1

| Polymer | Hydrophobic Anchors/ Molecular | MW Daltons | Molar ratio of backbone group (e.g., acrylate) to monomer with tail group (e.g., lauryl methacrylate) | Concn. Wt. % | Appearance |
|---|---|---|---|---|---|
| Decoupling Polymer | 0.9 | 9150 | 105.4 | 0.78 | Hazy |
| | | | | 1.30 | Hazy |
| Decoupling Polymer | 2.0 | 7500 | 37.2 | 0.75 | Hazy |
| | | | | 1.25 | Hazy |
| Decoupling Polymer | 1.3 | 3800 | 28.4 | 1.67 | Hazy |
| Decoupling Polymer | 1.8 | 3560 | 18.3 | 0.9 | Hazy |
| | | | | 1.5 | Hazy |
| Decoupling Polymer | 3.4 | 6100 | 16.4 | 0.83 | Hazy |
| | | | | 1.38 | Hazy |
| Decoupling Polymer | 2.8 | 2370 | 6.3 | 0.99 | Hazy |
| | | | | 1.65 | Hazy |

While not wishing to be bound by theory, applicants believe that, in contrast to Example 6, high levels of anionic do not increase hydrophobicity of composition and, therefore, compositions remain hazy.

EXAMPLE 8

Solubility of Hydrophobically Modified Polymers in Base Formulation Containing 0.0 Wt. Citrate and LAS, LES and Neodol 25-9 in the Ratio of 1:8:1

| Polymer | Hydrophobic Anchors/ Molecular | MW Daltons | Molar ratio of backbone group (e.g., acrylate) to monomer with tail group (e.g., lauryl methacrylate) | Concn. Wt. % | Appearance |
|---|---|---|---|---|---|
| Decoupling Polymer | 0.9 | 9150 | 105.4 | 0.78 | Hazy |
| | | | | 1.30 | Hazy |
| Decoupling Polymer | 2.0 | 7500 | 37.2 | 0.75 | Hazy |
| | | | | 1.25 | Hazy |
| Decoupling Polymer | 1.3 | 3800 | 28.4 | 1.00 | Hazy |
| | | | | 1.67 | Hazy |
| Decoupling Polymer | 1.8 | 3560 | 18.3 | 0.9 | Hazy |
| | | | | 1.5 | Hazy |
| Decoupling Polymer | 3.4 | 6100 | 16.4 | 0.83 | Hazy |
| | | | | 1.38 | Hazy |
| Decoupling Polymer | 2.8 | 2370 | 6.3 | 0.99 | Hazy |
| | | | | 1.65 | Hazy |

As in Example 7, solutions with higher levels of anionic are not believed to be as hydrophobic and, accordingly, polymers do not readily dissolve.

EXAMPLE 9

Formulations with and without acrylate/lauryl methacrylate copolymer (MW 4500, acrylate/lauryl methacrylate ratio=18.3) were evaluated for performance on dirty motor oil stains for stain removal.

Formulations used in the evaluation are listed in table below:

| Ingredient | Formulation 1 | Formulation 2 |
|---|---|---|
| Alcohol ethoxy sulfate, $C_{12}$–$C_{15}$, 3EO | 14.0 | 14.0 |
| Sodium alkyl benzene sulfonate, $C_{11}$–$C_{15}$ | 8.0 | 8.0 |
| Alcohol ethoxylate, $C_{12}$–$C_{15}$, 9EO | 8.0 | 8.0 |
| Sodium citrate dihydrate | 5.0 | 5.0 |
| Propylene glycol | 4.0 | 4.0 |
| Sodium borate pentahydrate | 3.1 | 3.1 |
| Sorbitol | 4.5 | 4.5 |
| Ethanol | 2.3 | 2.3 |
| Glycerol | 2.7 | 2.7 |
| Enzymes | 1.1 | 1.1 |
| Acrylate/lauryl methacrylate copolymer | 0.0 | 2.0 |
| Minors (fluorescer, perfume, colorant, preservative) | >0.5 | >0.5 |
| Water | to 100% | to 100% |

Swatches were prewashed in a dye free commercial liquid laundry detergent five times to age the material, remove spinning oils, and increase absorbency of the cloth. Cotton swatches were type TIC429 (Textile Innovators, Inc.); 50/50 polyester/cotton blend swatches were type TIC7403 (Textile Innovators,Inc.); polyester swatches were type TF730 (Textile Fabrics, Inc.)

Four replicate swatches were stained per fabric, per formulation, making a total of eight swatches per fabric. A measured quantity of dirty motor oil (10 drops per cotton swatch, 11 per polyester/cotton blend swatch and 25 per polyester swatch) was applied to the swatches in a 2" diameter circle at the center of the swatch. Care was taken to ensure that the oil uniformly coated the entire circle area. The stains were then allowed to age for one hour.

6.5 g of each formulation was applied per stained swatch and allowed to stand for 30 minutes.

The test formulations were then added (0.4 cup) to a filled (95° F., 120 ppm, 2:1 Ca:Mg) standard top-loading washing machine (Lady Kenmore model 80 heavy duty washer by Sears, Roebuck, and Co.) and allowed it to mix for one minute. The machine was then stopped and soiled test cloths treated with test formulation were added (4 each of cotton, 50/50 cotton/polyester blend, and polyester). The cloths then continued washing on the cotton/sturdy cycle of the washing machine, then were dried in a static dryer.

The stain removal was evaluated by comparing the L,a,b readings before staining and after washing. Readings were taken on a Gardner reflectometer with no ultraviolet light. The results are expressed as stain removal indices, where the stain removal index (SRI) is calculated as:

$$SRI=100-[(L_c-L_w)^2+(a_c-a_w)^2+(b_c-b_w)^2]^{1/2}$$

where the subscripts c and w represent clean swatches (before staining) and washed stained swatches, respectively.

L=Lightness index difference a, b=Chromaticity index difference (Colorguard System 2000 Colorimeter Operators Manual—BYK Gardner Inc., Silver Springs, Md., U.S. 20910)

Results for the two formulations are as follows:

| | Stain Removal Index | | |
|---|---|---|---|
| Formulation # | Cotton | Cot./poly. blend | Polyester |
| 1 | 67.77 | 57.65 | 37.91 |
| 2 | 69.30 | 60.00 | 37.99 |
| Least sig. diff. (95%) confidence interval) | 0.38 | 0.89 | 1.87 |
| Stain removal benefit of polymer | 2.53 | 2.35 | 0.08 |

Thus, formulation 2, which contains acrylate/lauryl methacrylate copolymer, clearly removes the stain better than does the formulation without polymer on cotton and on the poly/cotton blend.

EXAMPLE 10

The following formulae were tested for antiredeposition performance. The polymer tested was an acrylate/styrene copolymer with MW 3500 and an acrylate/styrene ratio of 1.5.

| Ingredient | Formulation 1 | Formulation 2 |
|---|---|---|
| Alcohol ethoxy sulfate, $C_{12}$–$C_{15}$, 3EO | 14.0 | 14.0 |
| Sodium alkyl benzene sulfonate, $C_{11}$–$C_{15}$ | 8.0 | 8.0 |

-continued

| Ingredient | Formulation 1 | Formulation 2 |
|---|---|---|
| Alcohol ethoxylate, $C_{12}$–$C_{15}$, 9EO | 8.0 | 8.0 |
| Sodium citrate dihydrate | 5.0 | 5.0 |
| Propylene glycol | 6.7 | 6.7 |
| Sodium borate pentahydrate | 3.1 | 3.1 |
| Sorbitol | 4.5 | 4.5 |
| Ethanol | 1.5 | 1.5 |
| Enzymes | 1.1 | 1.1 |
| Acrylate/styrene copolymer | 0.0 | 2.0 |
| Minors (fluorescer, perfume, colorant, preservative) | >0.5 | >0.5 |
| Water | to 100% | to 100% |

Both formulations were clear and stable.

Soiled swatches were made as described above. Unsoiled swatches were of the same materials described for soiled swatches and were prewashed before usage by the same method used for soiled swatches.

The test formulations were added (0.4 cup) to a filled (95° F., 120 ppm hardness, 2:1 Ca:Mg) standard top-loading washing machine (Lady Kenmore model 80 heavy duty washer by Sears, Roebuck, and Co.) and allowing it to mix for one minute. The machine was then stopped and test cloths (soiled by the procedure described in the previous example) were added (4 each of cotton, 50/50 cotton/polyester blend, and polyester). The washer was restarted and allowed to agitate for 90 seconds; then the unsoiled cloths were added (3 each of cotton, blend, and polyester; cotton first, then blend, then polyester) without stopping the machine. The cloths then continued to wash on the cotton/sturdy cycle of the washing machine, then were dried in a static dryer.

Because deposition of the oil onto clean fabric was uneven, it could not be quantified by the reflectance procedure described in the previous example. Instead, the deposition of oil onto the cloths was judged visually and a "score" assigned to swatches washed in each product. The "score" was a number between 0 (no deposition) to 5 (extensive deposition). The "scores" reported are averages of all the cloths of the fabric per test formulation. Little deposition was found on cotton or poly/cotton blend swatches for either formulation. For the polyester swatches, the scores were:

| Formulation # | Deposition score on polyester |
|---|---|
| 1 | 3 |
| 2 | 1 |

The results indicate that Formulation 2, with the acrylate/styrene copolymer, has improved anti-redeposition properties over the formulation without the polymer (Formulation 1). Both formulations are clear and stable; thus the polymer, which has an acrylate/styrene ratio of 1.5, can be stabilized in this formulation.

We claim:

1. An isotropic liquid detergent composition consisting essentially of:

(1) 1% to 85% by wt. of a surfactant selected from the group consisting of anionic, nonionic, cationic, amphoteric and zwitterionic surfactants and mixtures thereof;

(2) 0.1% to 25% by wt. hydrotrope wherein the hydrotrope is selected from the group consisting of propylene glycol, ethylene glycol, glycerol, sorbitol, mannitol, glucose and mixtures thereof and wherein said hydrotrope comprises less than about 2.5% by wt. alkyl aryl sulfonate;

(3) 0.1% to 20.0% electrolyte; and (4) 0.1% to 10% by wt. of a polymer having (a) a hydrophilic backbone comprising monomer units selected from the group consisting of:

(i) one ethylenically unsaturated hydrophilic monomer selected from the group consisting of unsaturated $C_{1-6}$ acids, ethers, alcohols, aldehydes, ketones or esters;

(ii) one polymerizable hydrophilic cyclic monomer units;

(iii) one or more non-ethylenically unsaturated polymerizable hydrophilic monomers selected from the group consisting of glycerol and other polyhydric alcohols; and (iv) mixtures thereof;

wherein said polymer is optionally substituted with one or more amino, amine amide, sulphonate, sulphate, phosphonate, hydroxy, carboxyl or oxide groups to specify one monomer only; and (b) a tail comprising a monomer comprising a pendant hydrophilic group and hydrophobic pendant group;

said polymer having a MW of 1,000 to 20,000;

wherein the molar ratio of backbone hydrophilic group to pendant hydrophobic group is less than about 10.

2. A composition according to claim 1 consisting essentially of 10% to 50% by weight surfactant.

3. A composition according to claim 1 wherein the surfactant is a mixture of anionic and nonionic surfactants.

4. A composition according to claim 3, wherein the surfactant is a mixture of linear alkyl aryl sulfonates (LAS), alcohol ethoxy alkoxylate sulfates (AES) and alkoxylated nonionics.

5. A composition according to claim 3, wherein the surfactants are used in a ratio of about 3:1 anionic to nonionic.

6. A composition according to claim 1 consisting essentially of 1% to 15% by weight hydrotrope.

7. A composition according to claim 1 wherein the hydrotrope is propylene glycol.

8. A composition according to claim 1, wherein, said alkylanyl sulfonate is selected from the group consisting of cumene sulfonate and xylene sulfonate.

9. A polymer according to claim 1 having the formula:

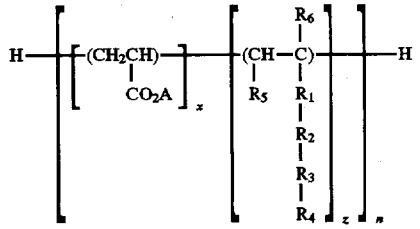

wherein z is 1;

x:z is less than about 10;

n is at least 1;

$R^1$ represents —CO—O—, —O—, —O—CO—, —$CH_2$—, —CO—NH— or is absent;

$R^2$ represents from 1 to 50 independently selected alkyleneoxy groups, or is absent, provided that when $R^3$ is absent and $R^4$ represents hydrogen or contains no more than 4 carbon atoms, then $R^2$ must contain an alkyleneoxy group with at least 3 carbon atoms;

$R^3$ represents a phenylene linkage, or is absent;

$R^4$ represents hydrogen or a $C_{1-24}$ alkyl or $C_{2-24}$ alkenyl group, with the provisos that a) when $R^1$ represents —O—CO—, $R^2$ and $R^3$ must be absent and $R^4$ must contain at least 5 carbon atoms;

b) when $R^2$ is absent, $R^4$ is not hydrogen and when $R^3$ is absent, then $R^4$ must contain at least 5 carbon atoms;

$R^5$ represents hydrogen or a group of formula —COOA;

$R^6$ represents hydrogen or $C_{1-4}$ alkyl; and A is independently selected from hydrogen, alkali metals, alkaline earth metals, ammonium and amine bases and $C_{1-4}$;

wherein the monomer units may be in random order.

10. A polymer according to claim 9, wherein the $R^2$ alkyleneoxy groups are ethylene oxide or propylene oxide groups.

11. A polymer according to claim 9, wherein the backbone monomer is acrylate and the monomer comprising hydrophobic pendant group is lauryl methacrylate.

12. A polymer according to claim 9, wherein the backbone monomer is acrylate and the monomer comprising hydrophobic pendant group is styrene.

13. A polymer according to claim 9, wherein molar ratio is less than 10.

14. A polymer according to claim 9, wherein molar ratio is less than about 7.

15. A polymer according to claim 9, wherein the molar ratio is greater than or equal to 1 to about 7.

* * * * *